United States Patent [19]

Testore

[11] Patent Number: 4,519,741

[45] Date of Patent: May 28, 1985

[54] MOBILE YARD CRANE FOR HANDLING CONTAINERS

[75] Inventor: Guido Testore, Ovada, Italy

[73] Assignee: ORMIG S.p.A., Ovada, Italy

[21] Appl. No.: 336,586

[22] Filed: Jan. 4, 1982

[51] Int. Cl.[3] ..... B66C 1/10

[52] U.S. Cl. ..... 414/738; 414/680; 414/718; 294/81.1; 212/233

[58] Field of Search ..... 212/233; 414/592, 680, 414/694, 4, 718, 733, 738; 91/520; 180/89.13; 294/815 F

[56] References Cited

U.S. PATENT DOCUMENTS

| | | | |
|---|---|---|---|
| 916,762 | 3/1909 | McFadden | 212/233 X |
| 2,354,182 | 7/1944 | Christoffersen | 212/194 X |
| 3,514,146 | 5/1970 | Zweifel et al. | 294/815 F X |
| 3,534,995 | 10/1970 | Heikkinen | 294/78 R |
| 3,684,104 | 8/1972 | Oda et al. | 212/233 X |
| 3,774,696 | 11/1973 | Horsch | 91/520 X |
| 3,944,098 | 3/1976 | Foote | 180/89.13 X |
| 4,166,712 | 9/1979 | Oberg | 414/680 X |

FOREIGN PATENT DOCUMENTS

| | | | |
|---|---|---|---|
| 0023864 | 2/1981 | European Pat. Off. | 414/4 |

*Primary Examiner*—Robert J. Spar
*Assistant Examiner*—Donald W. Underwood
*Attorney, Agent, or Firm*—Wenderoth, Lind & Ponack

[57] ABSTRACT

A mobile yard crane for handling containers or the like is disclosed, said crane includes at least two lifting jibs that act along vertical planes fixedly parallel to one another. The crane jibs are connected with one another, preferably by way of a hydraulic circuit, in order to ensure congruence and synchronism of their movements. The heads of the crane jibs are fitted with attaching devices for firmly retaining a container engaging apparatus or spreader at least at two locations thereof.

3 Claims, 6 Drawing Figures

MOBILE YARD CRANE FOR HANDLING CONTAINERS

BACKGROUND OF THE INVENTION

1. Field of the Invention

This invention relates to a yard crane for handling containers.

2. Description of the Prior Art

Handling of containers on loading and unloading yards involves a number of problems mainly relating to the safety in attaching the containers to the associated crane and handling the suspended containers. In particular, the solutions previously proposed by the known art do not appear to be satisfactory, since during handling containers by cranes, such containers may undergo changes in position or oscillating movements which, if and when critical values are reached, may become hazardous to the stability of both the load and crane.

The more these conditions, due to uncontrolled movements of the container during manipulation thereof, become dangerous, the more is the load inside the container likely to become unbalanced, and then to assume a position such that its actual center of gravity is considerably displaced as compared with the theoretic one.

SUMMARY OF THE INVENTION

According to what above, an object of this invention is to provide a mobile yard crane allowing for safe handling of containers, without any danger due to oscillating motions thereof, when suspended on the crane jib.

Accordingly, the invention provides a mobile yard crane for handling containers or the like, such crane including at least two lifting jibs acting along vertical planes fixedly parallel to one another, the jibs being connected to one another in order to ensure both the congruence and synchronism of the movements of the jibs, each of the jibs having a head with an attaching device for a known container engaging apparatus or spreader, such head attaching device acting at least at two locations of the spreader.

DESCRIPTION OF THE PREFERRED EMBODIMENTS

Figure 1:
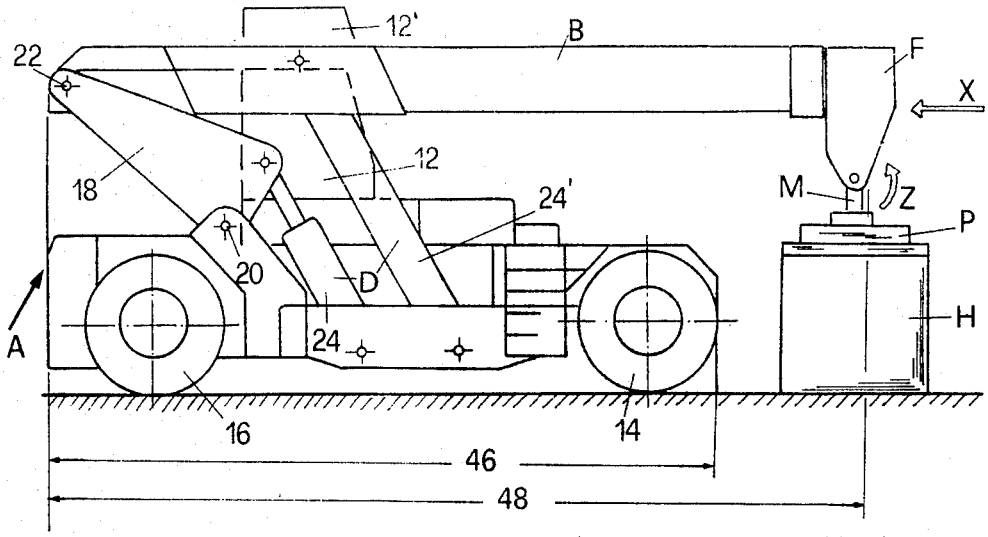
FIG. 1 is a diagrammatical, side view of a two jib crane truck with the crane jibs in their lowered position.
Figure 2:
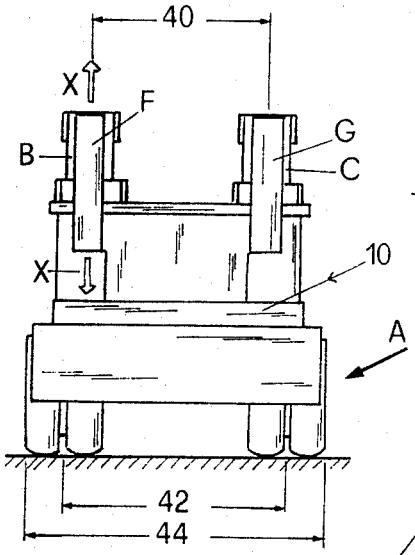
FIG. 2 is a diagrammatical front view of the crane, as seen in the direction of arrow X of FIG. 1.
Figure 3:
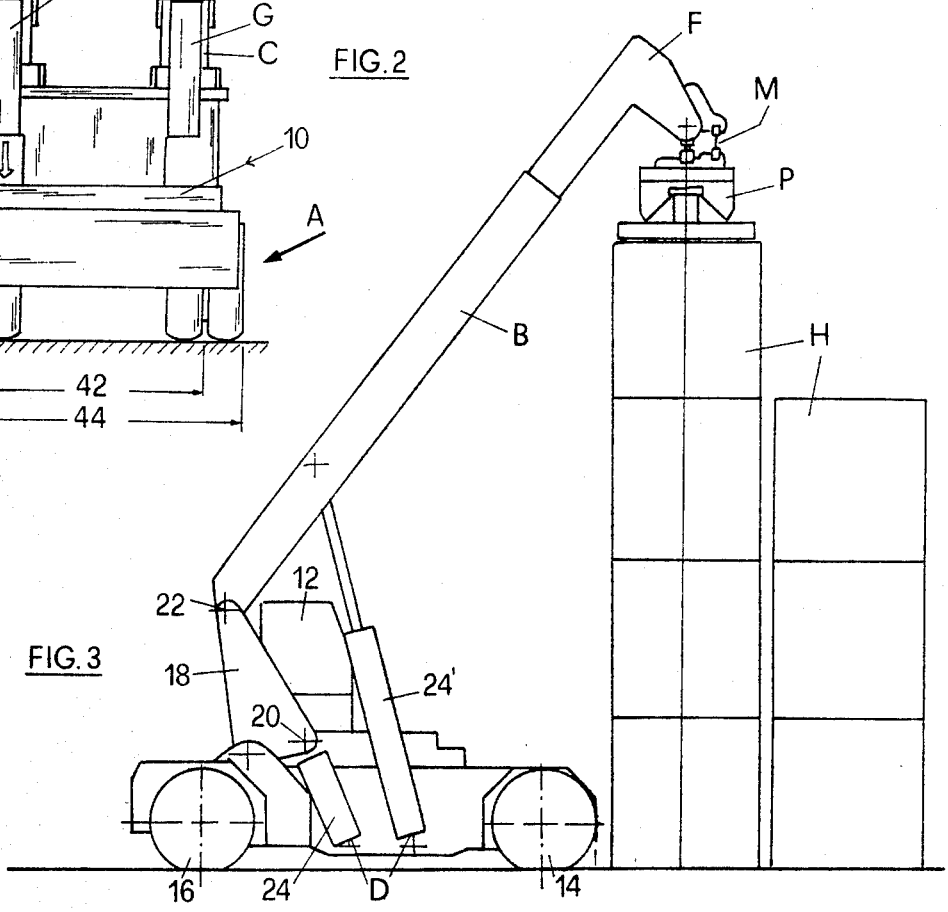
FIG. 3 is a diagrammatical, side view of the same crane, with the two jibs in their highest position.

With reference to the above figures, a mobile, self-propelled yard crane A includes a chassis 10 housing a driver's cab 12 which can be moved upwardly from a lower position 12 up to an upper position 12', depending on driver choice. Chassis 10 rests on the axles of front wheels 14 and rear wheels 16. Two or even more crane jibs are mounted on chassis 10 by means of structures associated to chassis 10. Each of these jibs B-C is connected to the other one in order to ensure congruency and synchronism in rotating, lifting, and lowering jib motions taking place only along vertical planes that are fixedly parallel to one another. Preferably, each jib is mechanically independent from the other but both jibs are connected by way of an appropriate hydraulic circuit, not illustrated, which is able to provide congruency and synchronism of motion of the jibs.

According to the illustrated embodiment, each of the two jibs B-C is connected to an associated part of chassis 10 by means of a connecting rod 18 that is pivoted at 20 and 22, respectively, to the chassis and to the respective jib. Each connecting rod 18 and the related jib are individually operated by two cylinders 24 and 24' which allow the load to be moved along any required path.

As shown, each crane jib is of a telescopic type and is formed by a number of sections which are able to nest into one another. The outermost sections of the crane jibs carry heads F and G, respective, which are designed to manipulate a semitrailer or container H. Each head F-G of the crane truck jibs is associated with a corresponding attaching device M, and the arrangement is such that the two attaching devices, and thereby the two jib heads, will firmly retain an apparatus or spreader P fixedly engaging a container H.

Actually each attaching device consists of a pair of rods, each of which is connected at one end with the associated jib head and at the other end with the spreader P. In a corresponding manner, the spreader has, at the top thereof, two pairs of attachment points for connection to the device M, while at its bottom the spreader will be provided, as is known, with four points of attachment for a container H. The spreader P can be formed, in a known manner, of two parts, namely a bottom part which is movable, upon actuation, with respect to an upper part that is fastened to the attaching devices M.

The connection of the attaching devices M to the spreader P is obtained by means of attaching elements acting both in a direction parallel and in direction perpendicular to longitudinal center-lines X—X of the jibs B-C and to the spreader longitudinal axis Y—Y. Due to such attaching conditions the spreader P will only be free to perform, with respect to the jib heads F-G, a dampened pivotal motion in planes parallel to the planes of the jibs, while no other freedom of movement, in any other direction, is possible for the spreader. As a result, the load H that is attached to the spreader P will in turn have the same freedom of movement as the spreader has, so that the load is not permitted, during manipulation, to take any hazardous attitude due to critical displacements, and a high degree of safety during the handling operation is obtained.

The spreader lower part, that is actuated by the operator, may in a known manner perform displacements in both the direction of the arrow T (see FIG. 4) and the reverse direction, as well as in a direction perpendicular to that of arrow T, the displacements in this latter direction allowing for the container to perform a controlled rotation of about 12°.

It has to be noted that the provision of the two crane jibs B-C allows the user to 'feel' an unbalanced condition of a load inside a container that is being manipulated, because the load weight acts on the two crane jibs in a manner different from one jib to the other and this gives the user a good opportunity of exerting due care in handling such unbalanced loads. In an actual example, the one center distance 40 between the two jibs B-C is 2.26 meters, while the values 42 and 44 are respectively 3.01 and 4.10 meters, the machine frame length 46 is 7.66 meters and the length 48 of each crane jib, with the head thoroughly retracted or nested is 9.15 meters. The spreader can be of a hydraulically adjustable type for hoisting of 20-30-40 ft containers, with possibility of adding attachments for 35 ft containers.

Figure 4:
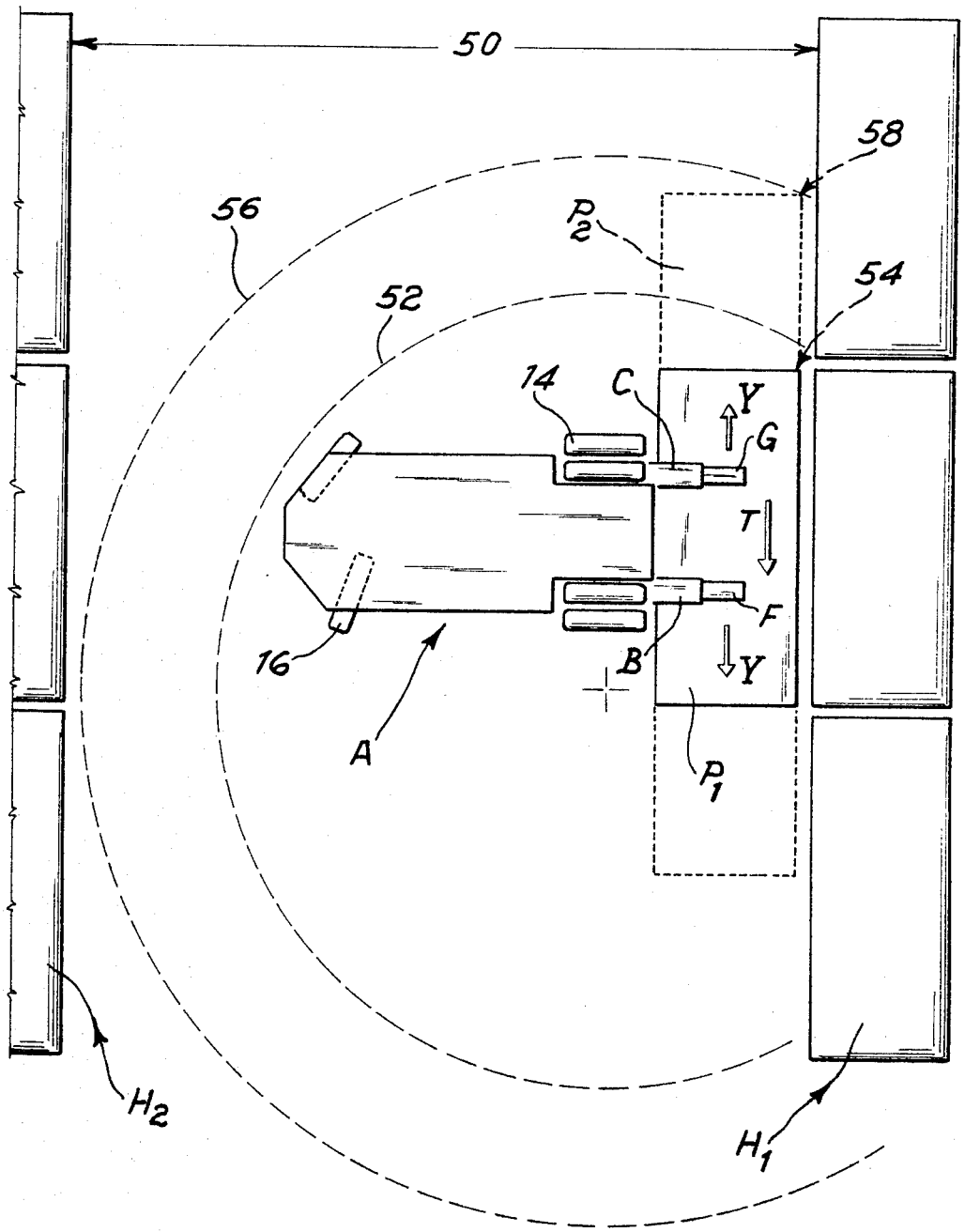
FIG. 4 is a diagrammatical plan view of a mobile crane on a container loading-unloading yard.

With reference to FIG. 4, a yard houses a number of containers arranged therein in two rows H1 and H2 that are spaced apart by a distance 50. Such distance must be of course sufficient for allowing the motions of the area servicing crane. As an example, reference 52 designates the path as described by the apex 54 of a 20 ft container P1 and 56 designates the path as described by the apex 58 of a 40 ft container P2, during rotating motions of the mobile crane A.

Figure 5:
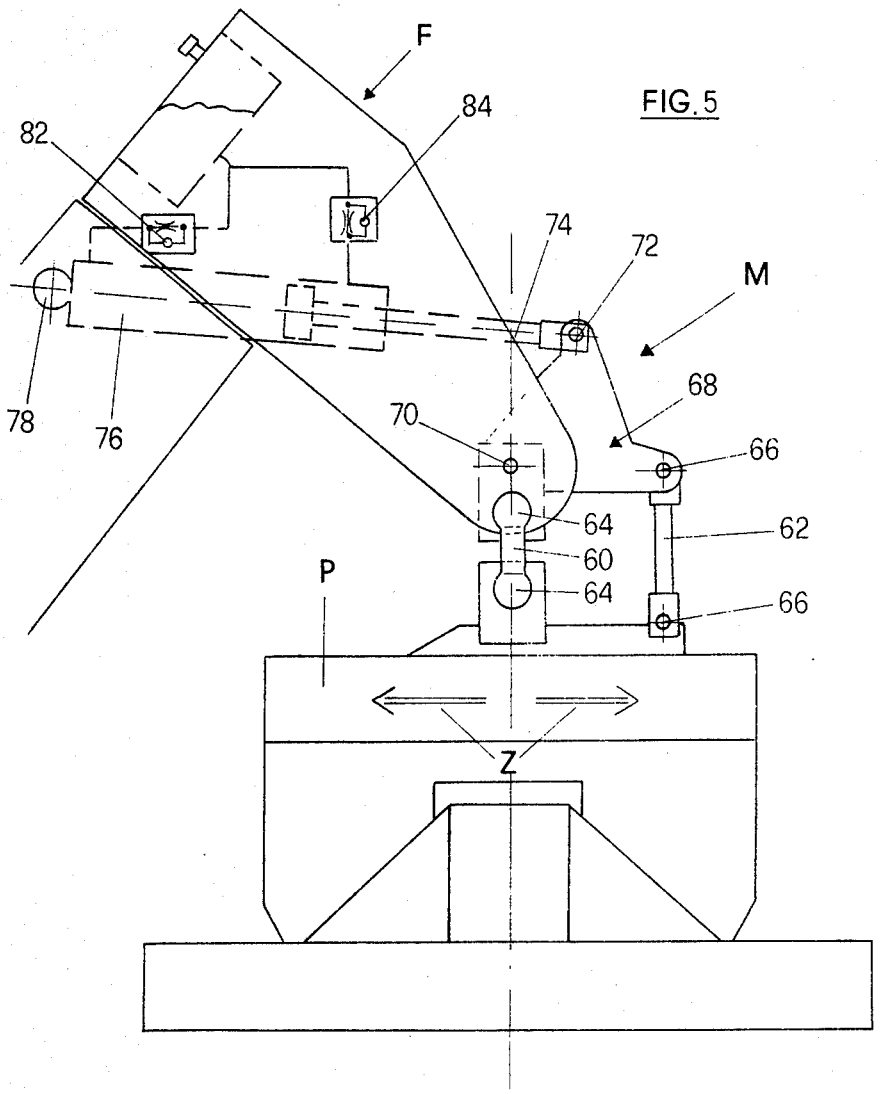
FIG. 5 is a diagrammatical detail view showing the head of one crane jib with means for preventing any uncontrolled container movement.

Referring now to FIG. 5, each jib head, for instance the jib head F, has an attaching device M, consisting of two rods 60, 62, the first of which is connected to the spreader P and to the head F by means of two ball-joints 64 allowing for a controlled rotation in all directions. The other rod 62 is pivotally connected at 66 to the spreader P and to a plate 68 which is in turn pivotally connected at 70 to the head frame. The plate 68 is pivotally connected at 72 to a piston rod 74 of a cylinder 76 hinged at 78 to the head frame. Cylinder 76 operates in order to dampen the oscillations of spreader P and accordingly the cylinder ends are hydraulically connected with an oil tank 80 via two damping valves 82 and 84.

During jib rotation, due to the lifting or lowering thereof, the piston rod 74 moves outwardly or inwardly, causing oil passage through the adjustable dampening valves 82, 84.

In the case of horizontal oscillating motions according to arrows Z, in particular due to sudden crane starting or stops, the container is allowed to oscillate with a more or less oscillating amplitude according to the value adjustment.

However, such oscillating motions are immediately dampened. The illustrated dampening system is used in order to avoid high stresses on the crane structure, as would occur in the case of a completely rigid connection between the heads and the container.

Figure 6:
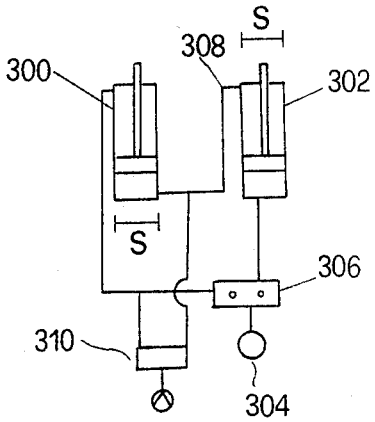
FIG. 6 is a diagrammatical view of compensation hydraulic circuit.

FIG. 6 shows an example of a hydraulic connection between two crane cylinders adapted to operate the two crane jibs with congruency and synchronism. In order to operate two cylinders 300–302, corresponding to the two crane jibs, the illustrated system comprises a pump 304 and a distributor 306 for delivering oil to, for example, a first cylinder 302, the outlet 308 of which is connected to the inlet of the second cylinder 300, the areas S of the first cylinder outlet and of the second cylinder inlet being equal. An electric valve 310 allows the two cylinders 300, 302 to be operated independently from one another when particular motions are required. Thus, according to the invention, it becomes possible to handle a container while maintaining the same parallel to itself independently from the actual position of its center of gravity.

It is to be understood that many changes and modifications may be made to the illustrated embodiments without departing from the spirit and scope of the invention.

I claim:

1. A mobile yard crane for handling large containers and the like, said crane comprising:

a mobile chassis;

at least two lifting jibs having respective first ends mounted on said chassis such that said jibs are movable with respect thereto in vertical planes which are parallel and fixed with respect to each other and respective second ends having fixed thereto respective jib heads;

spreader means supported by said jib heads of said jibs for engaging a container to be handled, said spreader means having a planar configuration;

separated attaching means for each said jib head for suspending said spreader means from said jib heads such that said spreader means is oscillatable with respect to said jib heads generally in a plane parallel to said vertical planes, each said attaching means comprising rigid and nonextendable articulated members including a plate pivotally connected to the respective said jib head, a first rod having opposite ends thereof swivelly connected to said respective jib head and to a first position on said spreader means, and a second rod having opposite ends thereof pivotally connected to the respective said plate and to a second position on said spreader means;

separate damping means for each said attaching means and the respective said jib head for damping oscillation of said spreader means;

separate hydraulic cylinder means connected to said chassis and to respective said jibs for moving said jibs independently in said respective vertical planes; and hydraulic control circuit means, connected to said separate hydraulic cylinder means, selectively for operating said separate hydraulic cylinder means in unison, thereby synchronously moving said jibs in said respective vertical planes, or for operating a selected one only of said separate hydraulic cylinder means, thereby moving only the respective said jib in the respective said vertical plane, and thereby inclinind the plane of said spreader means, whereby said spreader means may be positioned to engage an inclined container.

2. A crane as claimed in claim 1, further comprising respective connecting rods pivotally connected to said chassis and pivotally connected to said first ends of respective said jibs, and separate hydraulic cylinders supporting respective said connecting rods on said chassis.

3. A crane as claimed in claim 1, wherein each said damping means comprising a cylinder-piston unit including a cylinder pivotally connected to the respective said jib, and a piston rod movable with respect to said cylinder and pivotally connected to the respective said plate, and a source of hydraulic fluid connected to opposite ends of said cylinder by adjustable dampening valves.

* * * * *